US005664972A

United States Patent [19]

Zinn et al.

[11] Patent Number: 5,664,972

[45] Date of Patent: Sep. 9, 1997

[54] ELECTRICAL CONTACT ELEMENT

[75] Inventors: Bernd Zinn, Ennepetal; Srboslav Lolic, Wuppertal, both of Germany

[73] Assignee: Grote & Hartmann GmbH & Co. KG, Wuppertal, Germany

[21] Appl. No.: 365,899

[22] Filed: Dec. 29, 1994

Related U.S. Application Data

[63] Continuation of Ser. No. 53,457, Apr. 27, 1993, Pat. No. 5,437,566.

[30] Foreign Application Priority Data

Jul. 7, 1992 [DE] Germany ..... 9209097 U
Sep. 2, 1992 [DE] Germany ..... 9211819 U

[51] Int. Cl.[6] ..... H01R 4/48

[52] U.S. Cl. ..... 439/839; 439/852

[58] Field of Search ..... 439/842, 843, 439/839, 851–857, 861

[56] References Cited

U.S. PATENT DOCUMENTS 4,540,234 9/1985 Konnemann et al. ..... 439/839
5,288,252 2/1994 Steinhardt et al. ..... 439/851

*Primary Examiner*—David L. Pirlot
*Attorney, Agent, or Firm*—Jones & Askew

[57] ABSTRACT

The invention pertains to an electrical contact element composed of a perforated piece of sheet metal that has a connection region (3) for an electrical connection on one end and a contact region (2) with a polygonal cross-sectional spring-arm base (7) with smooth walls on the other end, where to form a contact casing (1) with a polygonal plug hole (15) defining the contact sites, at each of the front edges of the walls of the spring arm base (7) turned away from the connection area (3), at least one spring arm (14) extending in the direction of the plug hole (15) is provided; the spring arms (14) extend toward each other as far as the plug hole (15) and form it, and then are bent away at an angle to the outside to form a positioning funnel (10) for a contact plug pin in the front free end region.

22 Claims, 7 Drawing Sheets

FIG. 20
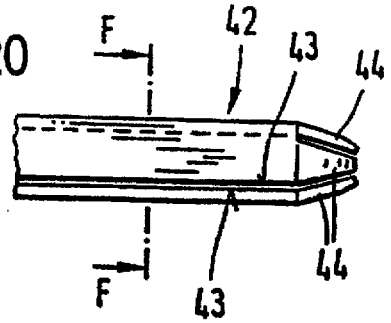
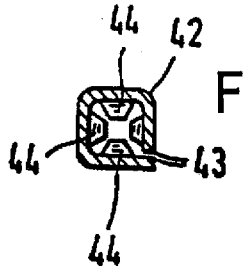
FIG. 21
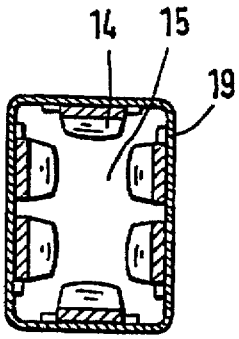
FIG. 24
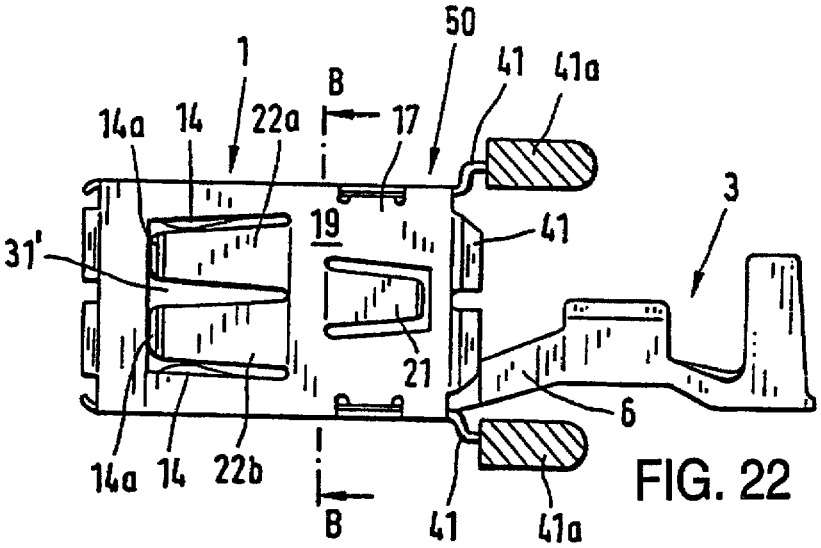
FIG. 22
FIG. 23
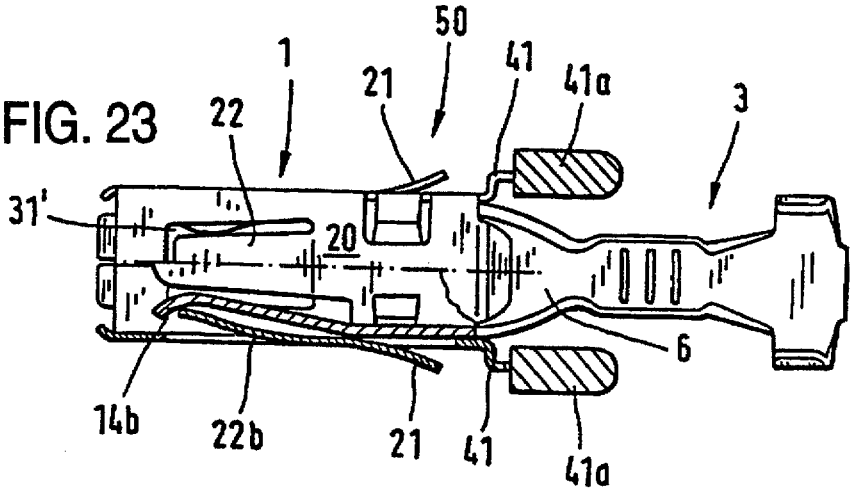

ELECTRICAL CONTACT ELEMENT

This is a continuation of application Ser. No. 08/053,457, filed Apr. 27, 1993 and now U.S. Pat. No. 5,437,566.

The invention pertains to an electrical contact element composed of a perforated piece of sheet metal.

Contact elements of this kind will sit in chambers of four-pole electrical plug connector housings, and as a rule the one plug connector housing includes contact element plug pins and the other plug connector housing is populated with contact element plug jacks. The plug connectors are, for example, a constituent of electrical systems in motor vehicles, washing machines or devices of this type, in which strong vibrations occur that have to be transferred at large current loads to the plug connector and thus also to the contact elements. Vibrations can adversely affect contact between the plug pins and the plug jacks in such a manner that disruptions of the electrical system will occur.

As is already known, round plug jacks with round plug pins will endure vibrations because the plug pins are trapped and cannot slide off to the side. However, it turns out that the contact quality itself is diminished for round plug jacks with protruding springs due to their great rigidity during the action of vibrations, and that the contact quality will become deficient particularly at large current loads.

In DE-PS 1490493 a single plug element having a flat spring arm is supplied with outer protruding springs in such a manner that when it is exposed to shaking or jolt stresses on the pertinent contact pin, it cannot slip out from the flat spring contact. This problem is solved due to the fact that on one of the spring arms, two spring tabs are provided that run perpendicular to it and form a single piece with it; these tabs are facing the other spring arm so that they form guide elements for lateral control of the contact pin. The contact pin should slide between these tabs during insertion, and are secured by it against lateral twisting or slippage. Thus the tabs form bounding elements and cannot improve the contact quality.

It is the task of the invention to create a contact element with very good contact quality, particularly for four-pole plug connectors that will permanently resist the action of strong vibrations and that is suitable particularly for the transfer of relatively large currents.

Figure 1:
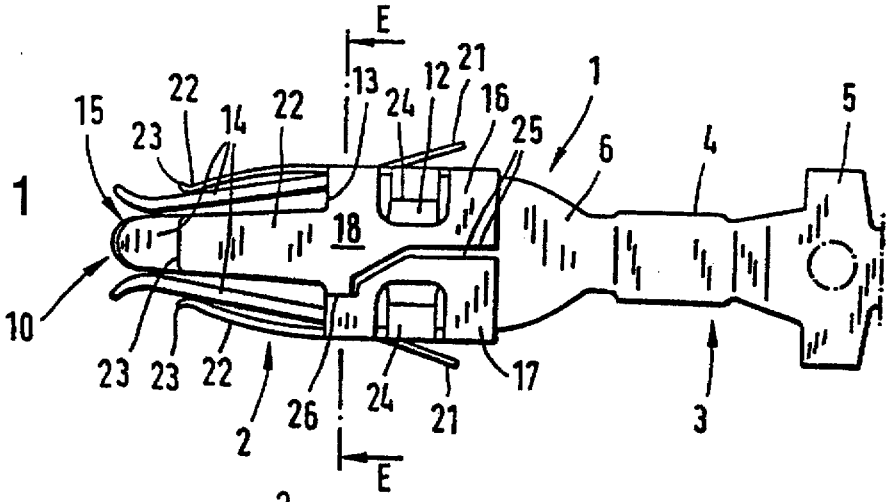
Figure 2:
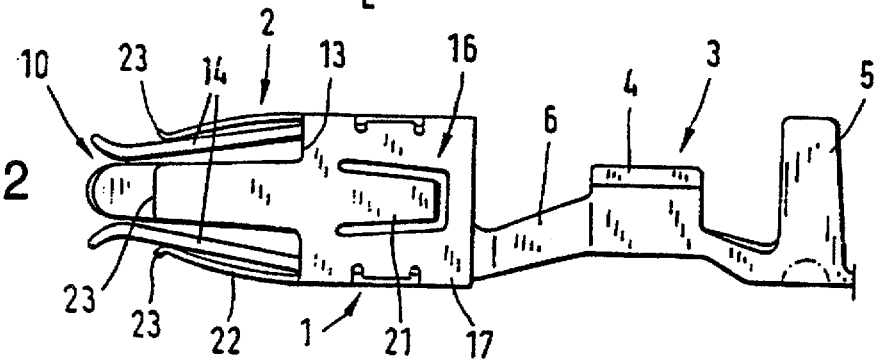

This problem is solved by the properties of claim 1. Favorable refinements of the invention are described in the subclaims. Based on the figures, the invention will be explained in greater detail below. We have:

FIG. 1: A bottom view of the contact casing of the first embodiment of the invention FIG. 2: A side view of the contact casing according to FIG. 1

Figure 3:
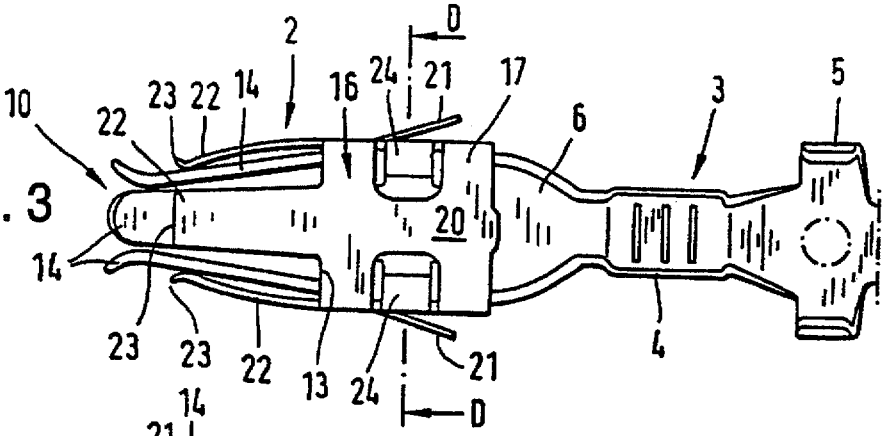

FIG. 3: A top view of the contact casing according to FIG. 1

Figure 4:
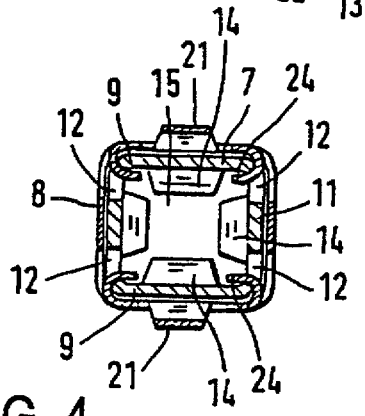
Figure 5:
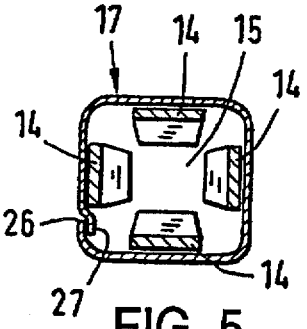

FIG. 4: A cross section through the contact casing along line D—D in FIG. 3 with a view in the direction of the arrow FIG. 5: A cross section along line E—E in FIG. 1 with a view in the direction of the arrow FIG. 6: A bottom view of the contact casing of an additional embodiment of the invention FIG. 7: A side view of the contact casing according to FIG. 6

Figure 8:
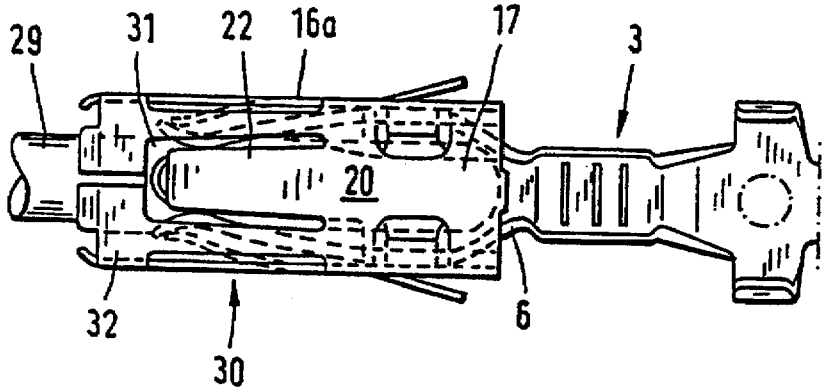

FIG. 8: A top view of the contact casing according to FIG. 6

Figure 9:
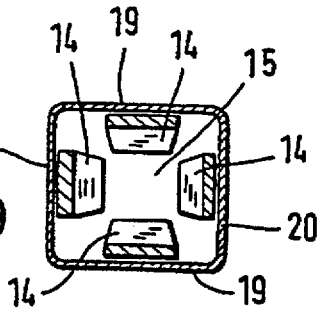
Figure 10:
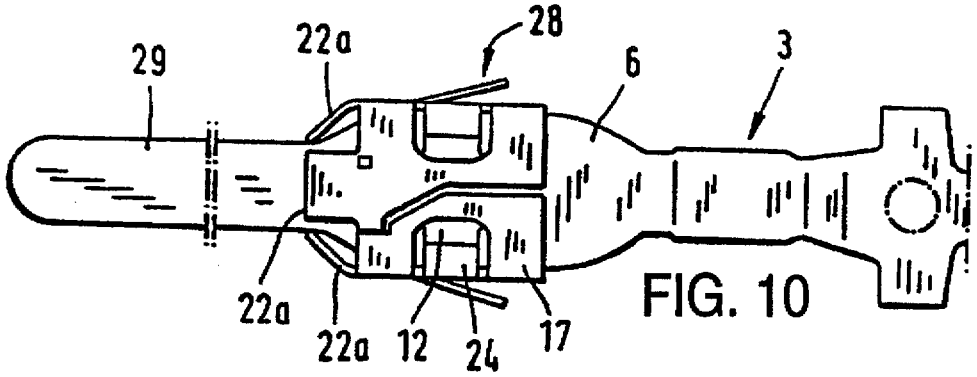
Figure 11:
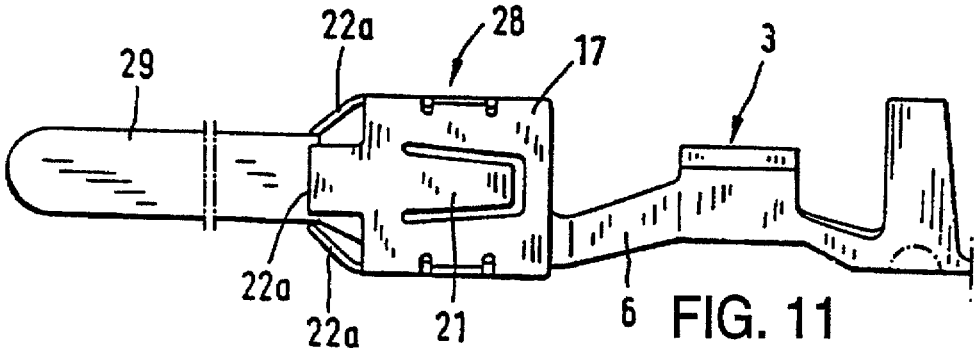

FIG. 9: A cross section through the contact casing along line E—E in FIG. 6 with a view in the direction of the arrow FIG. 10: A bottom view of a contact plug pin that fits with the contact casing FIG. 11: A side view of the contact plug pin according to FIG. 10

Figure 12:
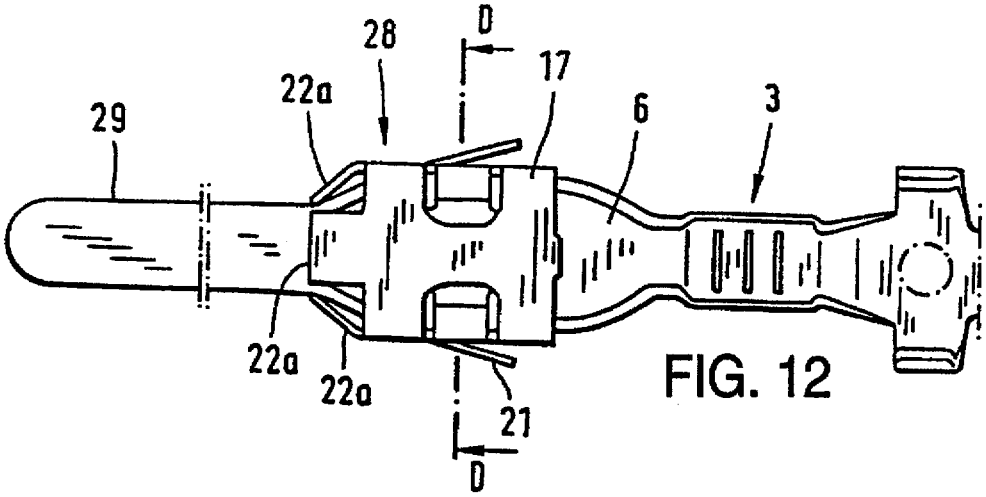

FIG. 12: A top view of the contact plug pin according FIG. 10

Figure 13:
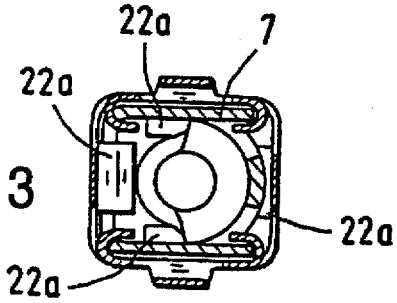

FIG. 13: A cross section through the contact plug pin along line D—D in FIG. 12

Figure 14:
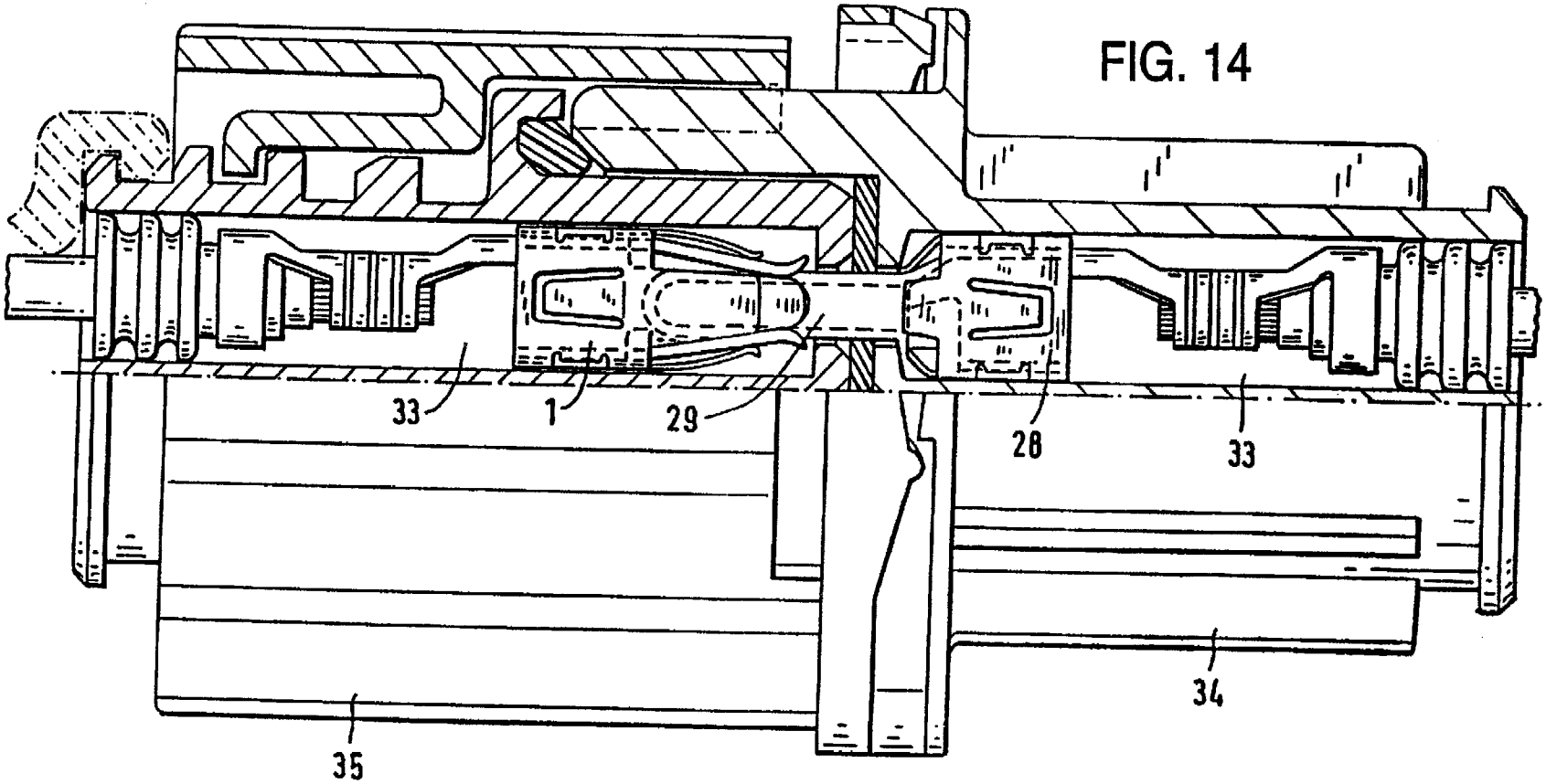
Figure 15:
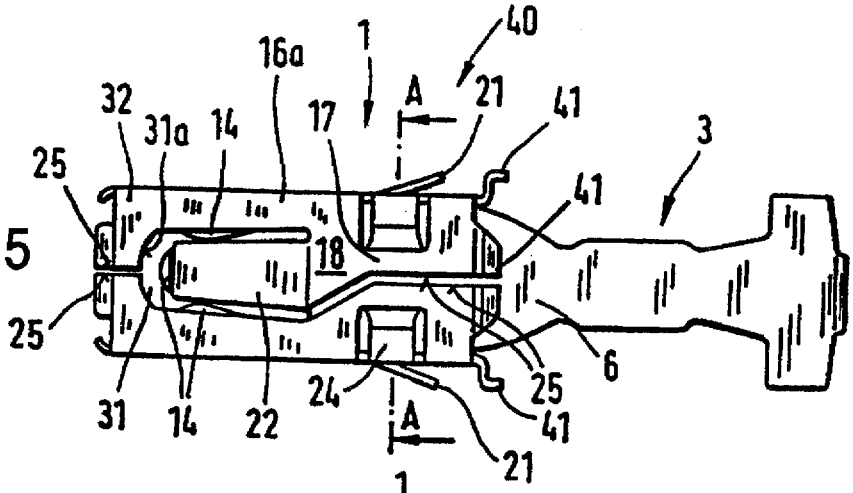
Figure 16:
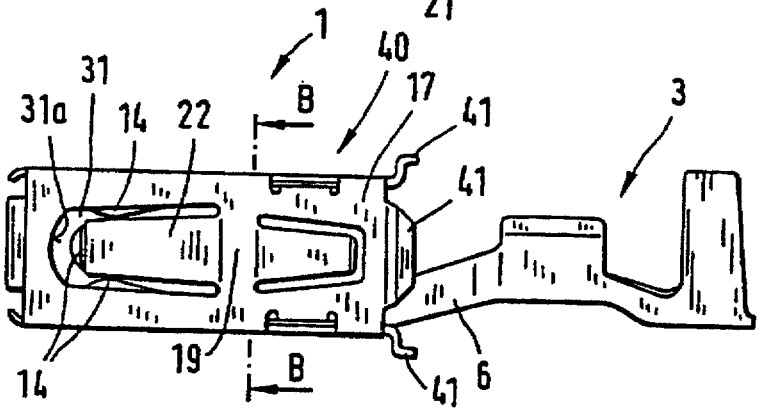

FIG. 14: A longitudinal cross section through a plug connector consisting of two plug connector housings including electrical contact elements according to this invention FIG. 15: A bottom view of a contact casing according to an additional embodiment of the invention FIG. 16: A side view of the contact casing according to FIG. 15

Figure 17:
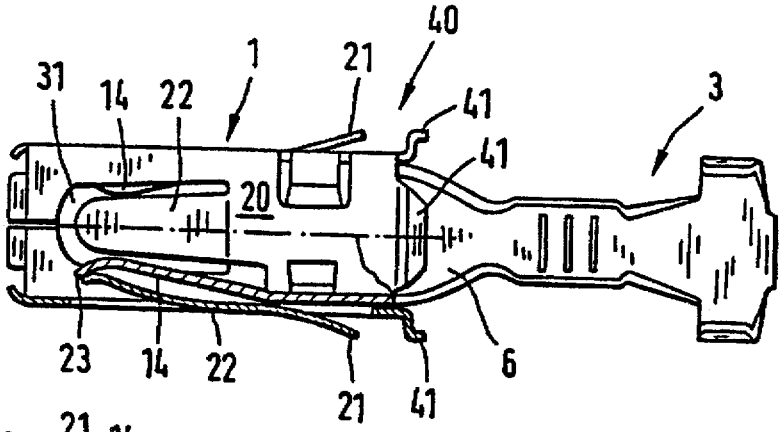

FIG. 17: A top view of the contact casing of FIG. 15

Figure 18:
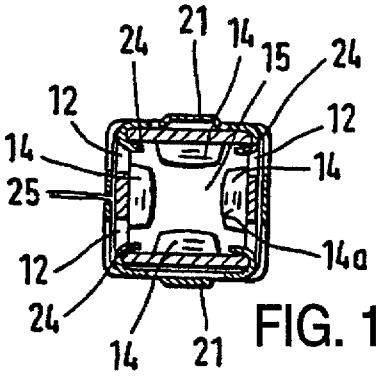

FIG. 18: A cross section through the contact casing along line A—A in FIG. 15 with a view in the direction of the arrow FIG. 19: A cross section through the contact casing along line B—B in FIG. 16 with a view in the direction of the arrow FIG. 20: A top view of a contact plug pin that fits with the contact casing according to FIG. 15

FIG. 21: A cross section through the contact plug pin along line F—F in FIG. 20 with a view in the direction of the arrow FIG. 22: A side view of a modified design of the contact casing according to FIG. 16

FIG. 23: A top view of the contact casing according to FIG. 22

FIG. 24: A cross section through the contact casing along line B—B in FIG. 22 with a view in the direction of the arrow FIG. 25: A top view of a contact plug pin that fits with the contact casing according to FIG. 22

Figure 25:
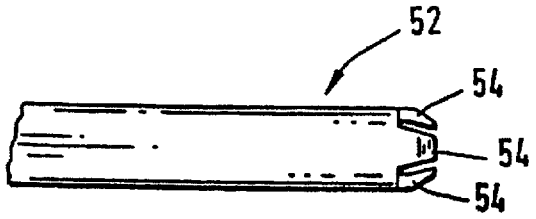
Figure 26:
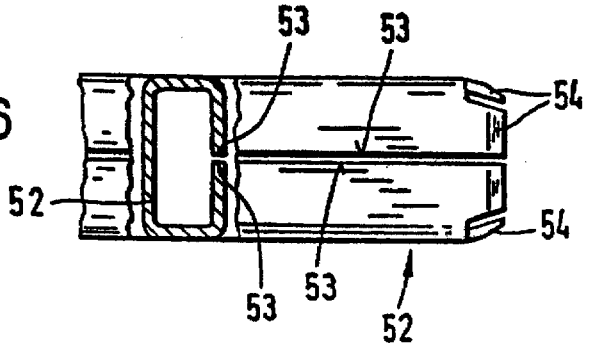

FIG. 26: A side view of the contact plug pin according to FIG. 25

Figure 27:
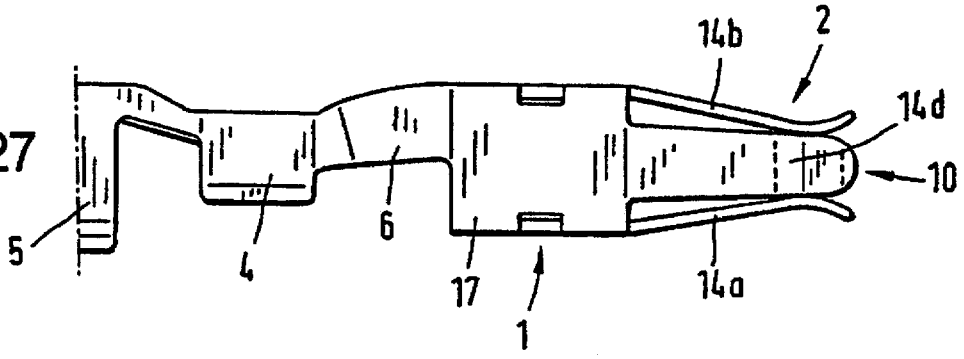

FIG. 27: A side view of an additional embodiment of the invention

Figure 28:
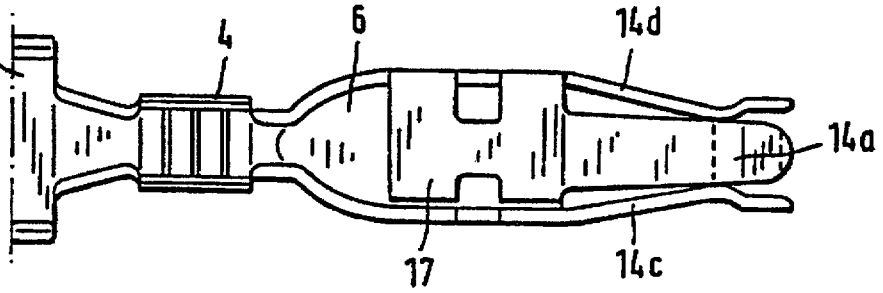

FIG. 28: A top view of the contact casing of FIG. 27

Figure 29:
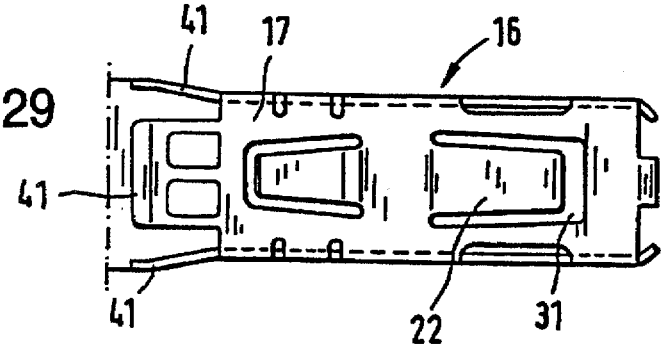

FIG. 29: A side view of an additional embodiment of the outer protruding springs for the contact casing according to this invention.

The contact casing 1 according to this invention consists of a perforated piece of sheet metal with a front contact region 2 and a rear connection region 3. The connection region 3 has generally known crimping arms 4,5 for a crimp with a conducting electrical wire (not shown). The connection region 3 can be designed for a different kind of connections, e.g., for a solder connection, insulation displacement connection or other kinds. The connection region 3 passed over via a transition region 6 into the contact region 2.

The contact region 2 adjoining the transition region 6 has a box-like, rectangular cross section spring arm base 7 (see FIG. 4) with a base wall 8, two side walls 9 and one covering wall 11. Roughly in the longitudinal middle portion of the spring arm base 7 a locking hole 12 is punched out in the base and in the covering wall 8, 11 in the region of each longitudinal bending edge of the spring arm base 7. The function of holes 12 will be further explained below.

It is important that at the free front edge of each wall 8, 9, 9, 11 that is not visible in the figure, at least one contact spring arm 14, preferably of the same spatial form, extends forward and is connected. Opposing spring arms 14 converge toward each other, so that a roughly rectangular plug hole 15 is formed at the tightest location in the front end region. Proceeding from the plug hole 15, the free end regions of the spring arms 14 are curved and bent outward so that a positioning funnel 10 is formed for the plug hole 15.

Due to the arch-like bending of the spring arms 14 in the region of the plug hole 15, contact sites are formed that are pointed or linear according to the cross-sectional shape of the spring arms 14 in the region of the plug hole 15. Essentially pointed contact sites are obtained for spring arms 14 with a cross section bulged inward toward the longitudinal middle axis of the contact region 2. Linear contact sites are obtained for planar spring arms 14. In the illustrated embodiment, all the contact sites defining the plug hole 15 are at the same level or essentially within one plane, viewed in the plug direction, that passes perpendicularly through the longitudinal middle axis of the contact region 2. That means that an opposing contact element inserted into the plug hole 15 will be contacted by means of four contact sites at the same level in a contact site located in the plug direction.

According to the invention therefore, a contact casing element with four spring arms 14 will be created in whose interior a contact plug pin can be held. Depending on the quantity, shape and bending of the spring arms 14, a polygonal, e.g. square or rectangular, plug hole 15 can be formed. The plug hole 15 is tailored to the spatial shape of the contact plug pin so that optimum contact can be assured, where all spring arms 14 rest against the plug pin and together form one contact site so that a contact region with a quantity of contact sites will be available that corresponds to the number of spring arms.

According to one special design of the invention, an outer protruding spring 16, e.g., made of steel sheet metal, sits on the spring arm base 7 of the contact casing 1. The outer protruding spring 16 has a box-like protruding spring arm base 17 seated form-fit on the spring arm base 7; this protruding spring arm base has a cover wall 18, two side walls 19 and one base wall 20. In the two side walls 19 there is a snap spring tongue 21 pointing in the direction of the connection region 3 that is bent away to the outside and is cut free by a U-shaped open cut. The snap spring tongues 21 are used in a known manner for axial motion restriction of the contact element in a contact chamber of the plug connector housing.

At the free front edge 13 of each wall 18, 19, 19, 20 of the protruding spring arm base 17, there is at least one connected protruding spring arm 22. The protruding spring arms 22 extend at a small distance over the spring arm 14 and their free front edge 23 comes to rest shortly in front of the plug hole 15 on the particular spring arm 14.

In the region of the locking holes 12, proceeding from the corresponding longitudinal edge of the protruding spring arm base 17, there is one U-shaped locking tab 24 whose width corresponds to the width of a hole 12 cut into the base and cover wall 20, 18 and that is bent away toward the particular locking hole 12 so that the tab 24 extends into the interior of the spring arm base 7 and, in a known manner, restricts the motion of the protruding spring 16 in the longitudinal direction of the contact casing 1 on the spring arm base 7, and also prevents a spring-action of the spring arm base 7.

The covering wall 18 of the protruding spring arm base 17 has the impact edges 25 extending parallel to the longitudinal direction of the contact casing 1 for each of the contact elements composed of a perforated piece of sheet metal. These impact edges run preferably at the rear edge of the protruding spring arm base 17 beginning in the transverse middle section of the wall 18 and extend about half the length of the base 17 at an angle to the bending edge of the protruding spring arm base 17, and in the front end region 26, they extend parallel to the bending edge in the front edge 13 next to the connection of the protruding spring arm 22. In region 26 the one edge of the impact edge 25 runs under a stop tab 27 (FIG. 5) that is connected in this region to the other impact edge 25. This undersupport of the stop tab 27, particularly in conjunction with the locking features 12, 24, will cause a spring support of the protruding spring arm base 17 when inserting a contact plug pin.

Figure 6:
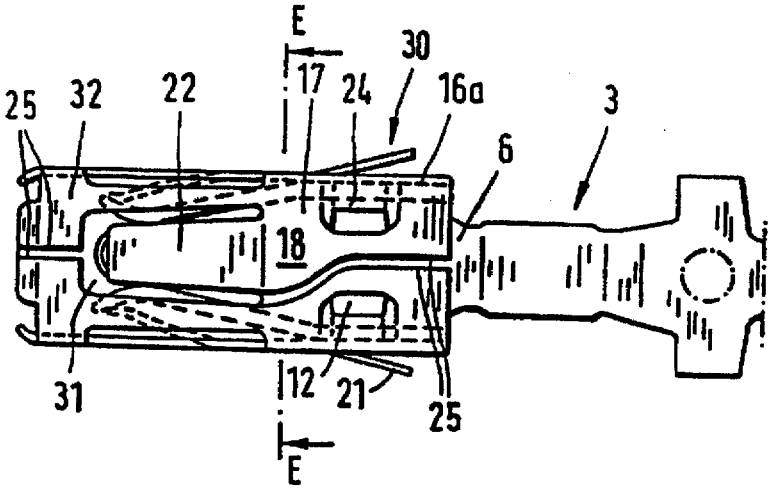
Figure 7:
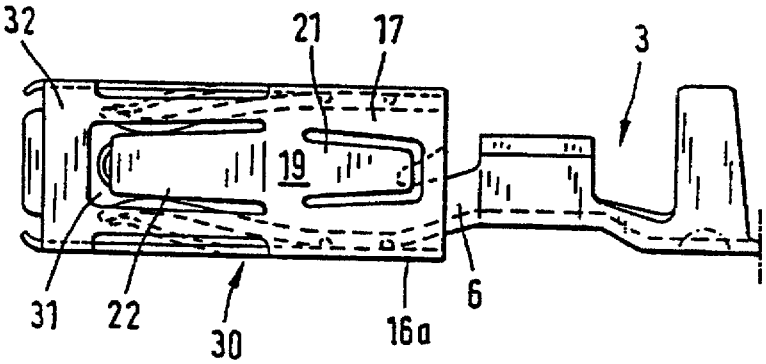

The contact element 30 presented in FIGS. 6 to 9 likewise has a contact casing 1 which is why these figures contain only those reference numbers necessary for orientation. The one difference to the structure of the contact element presented in FIGS. 1 to 5 is the shape of the outer protruding spring 16*a*, but the protruding spring arm base 17 is still of the same design as the protruding spring arm base of the outer protruding spring 16. It is important that the walls 18, 19, 19, 20 extend a little beyond the positioning funnel 10, and the protruding spring arms 22 are formed in the walls by U-shaped open cuts 31. The outer protruding spring 16*a* thus ends in the front end region at an insulating frame 32. The impact edges 25 align in the insulating frame 32 with the rear initial region of the impact edge in the protruding spring arm base 17 (FIG. 6). The box of the outer protruding spring 16*a* protects the contact region of contact casing 1 in the vicinity of the plug hole 15 and ensures a stable mounting of the contact element 30 in an appropriately shaped contact chamber of a plug connector housing.

According to one particular embodiment of the invention, a contact pin element 28 for the contact casing 1 is provided with a round plug pin 29 according to FIGS. 10 to 13. The contact plug pin is of the same spatial design as the contact casing 1 in its connection region 3, transition region 6 and in the regions of the spring arm base 7, 17.

However, the smaller diameter round plug pin 29 is connected to the front edge of the box-like base section 7. A short bracing tab 22*a* is connected at the location of the protruding spring arms 22 to the particular walls 18, 19, 19, 20, and is bent away at an angle to the round plug pin 29, whereby the free front end edge of the tab comes to rest against the surface of the round plug pin 29. The bent tabs 22*a* form slanted contact areas that promote the insertion of the contact pin element 28 into a contact chamber of a plug connector housing, since the edges of one chamber opening can run up against the contact slants in case of a not quite exact central insertion of the contact pin element, thus guiding the contact pin element through the slanted areas and into the chamber.

The consistent shapes of the contact pin element 28 with the corresponding shapes of the contact casing element presented in FIGS. 1 to 5 make it possible to use identically shaped plug connector housings in the interior for both contact elements because both contact elements will fit into contact element chambers of the housing of the same shape.

FIG. 14 shows the two contact elements 1 and 28 in an identically designed contact element chamber 32 of two plug connector housings 34, 35 that are plugged together so that the contact plug pin 29 extends through the plug hole 15 of the contact plug jack 1 and is contacted there.

The contact site of contact casing 1 or of contact element 30 formed by the four spring arms 14 can permanently absorb large vibrations due to the favorable spring characteristic of the spring arms 14 that is ensured in particular by the protruding spring, without the contact quality being adversely affected even under relatively strong current flow.

Thus, according to the invention, it is possible to create polygonal plug holes in contact casings and to set up a number of contact sites in the region of the plug hole in a plane transverse to the plug direction of the plug pin around the plug pin, wherein each individual contact site can spring out transverse to the plug direction so that large vibrations can be absorbed at high current flow, without the contact quality being thereby adversely affected.

The contact element 40 presented in FIGS. 15 to 19 represents a modification of the contact element 30 presented in FIGS. 6 to 9 and is likewise composed of the contact casing 1, which is why only those reference numbers needed for orientation are presented in these figures. In contrast to the design of the contact element 30 presented in FIGS. 6 to 9, in the contact element 40, the base side 31*a* of the U-shaped open cuts 31 forming the protruding spring arms 22 are curved. Another difference consists in the structure of locking shoulders 41 that are molded as a single piece to the edges of the protruding spring arm base 17 facing the connection region 3. The locking shoulders 41 extend in roughly an S-shape and protrude to the side from the base 17. The free edges of the locking shoulders 41 are intended to mesh with a locking mechanism, that is formed, for example, as slides (shown as examples in FIGS. 22 and 23) with the contact chambers of a plug connector housing (not illustrated).

Another difference in the contact element 40, shown in FIGS. 15 to 18 with respect to the contact element 30 presented in FIGS. 6 to 9, consists in the fact that an expansion or over-bending protector is provided for the spring arms 14 and the protruding spring arms 22. This over-bending protector ensures that the spring arms 14 are designed long enough, or that the insulating frame 32 of the outer protruding spring is designed wide enough, so that the spring arms 14 come to mesh with the inner surface of the insulating frame 32 at a maximum expansion in the direction transverse to the longitudinal middle axis of the contact element 30. In addition, the free front edges of the protruding spring arms 22 shift directly onto the spring arms in the region of the free front edge of the spring arm 14.

Figure 19:
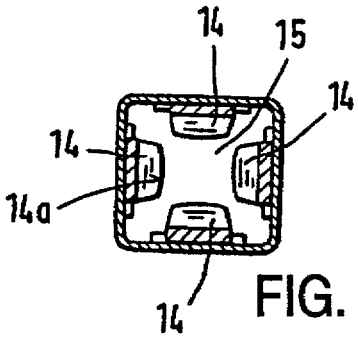

Another difference in the contact element 40 with respect to contact element 30 consists in the fact that the spring arms 14 are of spherical design, at least in the region of its free front edge, as is illustrated by the concave contour 14*a* in FIGS. 18 and 19. The spherical formation of the spring arms 14 is thus anticipated, because the contact partner for the contact element 40 of the contact plug pin 42 presented sectionally in FIGS. 20 and 21 is already provided. The contact plug pin 42 has a rectangular cross section, that is, in particular, a square cross section. The contact plug pin 42 is formed as a perforated piece of sheet metal with two mutually opposing side surfaces and with impact edges 43, 43 running in an axial direction that are placed in a longitudinal edge region of the pin 42. At the front edges of the plug pin 42 there are trapezoidally shaped, forward tapered tongues 44 provided in an extension of the side walls; these tongues are bent away toward the middle longitudinal axis of the plug pin 42 and form an insertion point for insertion into the contact element 40. The smooth side walls of the pin 42 come into linear contact with the spherically shaped spring arms 14.

The contact element 50 illustrated in FIGS. 22 to 24 represents a modification of the contact element (40) shown in FIGS. 15 to 19. The modification consists essentially in the fact that a pair of spring arms 14*a*, 14*b*, or a pair of protruding spring arms 22*a*, 22*b* are provided at the side walls of the spring arm base and at the side walls 19 of the protruding spring arm base 17; their particular profile corresponds to the spring arms 14 or to the protruding spring arms 22 of the contact elements described above. Since these spring arms and protruding spring arms have essentially the same dimensions as the spring arms and protruding spring arms described above, the width dimension of the particular, base side walls is greater than for the design described above, so that the contact casing and the protruding spring have a rectangular cross section, as is best seen in FIG. 24. In this embodiment as well, an expansion or overbending protector is provided for the spring arms or for the protruding spring arms, as has been described above with reference to contact element 40. In addition, FIGS. 22 and 23 show schematic cross sections of the slides 41*a* that cooperate with the locking shoulders 41 of the contact element 50.

FIGS. 25 and 26 provide views (FIG. 26 shows a partially cut view) of the contact plug pin 52 cooperating with the contact element 50; this pin is basically of the same design as the contact plug pin 42 (FIGS. 20 and 21), with the difference that the contact plug pin 52 has a rectangular cross section, and the impact edges 53 are formed in the wider wall of the pin.

FIGS. 27 and 28 show an additional embodiment of the contact element according to this invention that essentially corresponds to the preceding embodiments of the invented contact element. In contrast to the embodiments of the invented contact element described above, in which the contact sites defining the plug hole reside at the same level in the plug direction, the design of the spring arms 14 according to FIGS. 27 and 28 is made so that contact sites are provided that are offset in the plug direction. Due to these contact sites offset in the plug direction, the insertion forces needed for a complementary contact element will be reduced compared to the embodiments in which the contact sites are located at the same level viewed in the plug direction.

In particular, according to the embodiments of FIGS. 27 and 28, the contact sites at the two opposing spring arms 14*a* and 14*b* that are joined to the base and cover the front edges of the spring arm base 7 are located in front of the contact sites in the plug direction that are formed at the two other mutually opposing spring arms 14*c* and 14*d* that are joined to the side wall front edges of the spring arm base 7. This is attained since the spring arms 14*a*, 14*b* or 14*c*, 14*d* are bent away to the outside in bowed fashion at differing positions with respect to longitudinal middle axis of the contact region 2 that form the positioning funnel 10 for the plug hole 15. In particular, the pairs of spring arms 14*a*, 14*b* are bent away to the outside at the spring arm base 7 at a greater distance to their connecting edges than the pair of spring arms 14*c*, 14*d*, whose forward regions adjoining the bent portion extend in a straight line at about the same level and parallel to the longitudinal middle axis of the contact region 2 on which the contact sites with the other pair of spring arms 14*a*, 14*b* are formed.

FIG. 29 shows a modified embodiment of the outer protruding spring for the contact element according to this invention in a side view. This design of the outer protruding spring 16 has locking elements 41, similar to the protruding spring illustrated in FIG. 16, with which the outer protruding spring can be locked in the contact chamber wall of a plug connector housing. The locking organs 41 are mounted to the rear edge of the walls toward the back and on the side by using the cross-sectional contour of the outer protruding springs 16. The locking elements [sec; 41] are designed as elongated spreader arms in this embodiment, whose free end edges protrude outward at an acute angle from the cross-sectional contour of the outer protruding spring 16. These locking spreader arms 41 have spring properties and make it possible to absorb vibrations that are transferred to the outer base spring.

We claim:

1. Electrical contact element comprising:

a perforated piece of sheet metal that has a connection region (3) on one end for an electrical connection and a contact region (2) with a polygonal cross-sectional spring-arm base (7) with smooth walls on the other end;

the walls of the spring arm base (7) having front edges facing away from the connection region (3);

at least one spring arm (14) extending from each front edge of the polygonal spring arm base to form a contact casing (1) with a polygonal plug hole (15) whereat the spring arms are in mutually spaced-apart relation defining contact sites; and wherein the spring arms (14) extend toward each other as far as the location of the plug hole (15) so as to form the plug hole, and then bend away at an angle to the outside to form a positioning funnel (10) for a contact plug pin in a front free end region of the spring arms.

2. A contact element according to claim 1, characterized in that the contact sites in the plug direction reside at the same level or rest in a common plane extending perpendicular to the longitudinal middle axis of the contact casing (1), configured essentially as pointed or linear contact sites.

3. A contact element according to claim 1, characterized in that the spring arm base (7) is of box-like design with a rectangular cross section and has a base wall (8), two side walls (9), and one cover wall (11) wherein the width of the walls is greater than the width of the spring arms (14), and the spring arms (14) are joined transversely to the middle of the base wall, the two side walls, and the cover wall.

4. A contact element according to claim 1, characterized in that the contact sites are located in the plug direction at least partly offset with respect to each other.

5. A contact element according to claim 4, characterized in that at least two of the contact sites are located on a common vertical along the longitudinal middle axis of the contact casing (1).

6. A contact plug pin according to claim 5, characterized in that the connection region (3) spatially corresponds to the connection region of the contact casing (1, 30).

7. A contact element according to claim 1, characterized in that an outer protruding spring (16) is sitting on the spring arm base (7) of the contact casing (1).

8. A contact element according to claim 7, characterized in that the outer protruding spring (16) has an outwardly bent snap tension spring (21) formed by a U-shaped open cut pointing in the direction of the contact region (3) in at least one wall of the protruding spring arm base (17).

9. A contact element according to claim 8, characterized by a box-like protruding spring arm base (17) having a rectangular cross section with a cover wall (18), two side walls (19) and one base wall (20) where one snap spring tongue (21) is provided in each of the two side walls (19).

10. A contact dement according to claim 7, characterized in that the outer protruding spring (16) has a form-fit protruding spring arm base (17) with smooth walls seated on the spring arm base (7) wherein at least one protruding spring arm (22) is joined to each front edge (13) of the walls, the protruding spring arms (22) extend at a small distance beyond the spring arms (14) and a front edge region (23) of the protruding spring arms (22) touches the particular spring arm (14) just in front of the plug hole (15).

11. A contact dement according to claim 10, characterized in that the protruding spring arm base (17) surrounds the spring arm base (7) in such a manner that an expansion of the spring arm base (7) is prevented.

12. A contact element according to claim 10, characterized in that the walls (18, 19, 19, 20), of an outer protruding spring (16*a*) extend beyond the positioning funnel (10) where the protruding spring arms (22) are formed in the walls through corresponding U-shaped open cuts (31).

13. A contact element according to claim 12, characterized in that the outer protruding spring (16*a*) ends in the front end region with an insulating frame (32) extending transverse to the plug direction.

14. A contact dement according to claim 8, characterized in that in the insulating frame (32) the contact edges (25) are aligned with a rear leading region of the contact edges in the protruding spring arm base (17).

15. A contact plug pin (28) made of a perforated piece of sheet metal for a contact casing (1, 30) of a contact element (1) according to claim 1, the contact plug pin comprising a plug pin on one end that fits with a connection region (3) for an electrical connection, and with another end having a plug pin (29) that fits into the plug hole (15) of the contact casing, a protruding spring base section on a base portion of the contact plug pin, said base portion corresponding spatially to the spring arm base (7) of the contact element (1), and the protruding spring base section being configured to fit in an identical contact chamber of a connecting housing and having a polygonal cross section spatially corresponding to the protruding spring arm base (7), for a snug fit of the contact plug pin in the contact chamber.

16. A contact element according to claim 10, characterized in that the spring arm base (7) and the protruding spring arm base (17) are of rectangular cross section, and the rectangular bases respectively have widths from which extend corresponding pairs of spring arms (14*a*, 14*b*) and protruding spring arms (22*a*, 22*b*).

17. A contact plug pin (42, 45) made of a perforated piece of sheet metal for the contact element (40, 50) according to claim 16, with the contact plug pin having a rectangular cross section and an insertion point at the front end that is formed by sections (44) that are bent toward each other.

18. A contact element according to claim 16, characterized in that the regions of the spring arms (14*a*, 14*b*) coming into contact with the allocated contact pin are of spherical design or are concave to the path of their longitudinal motion.

19. A contact element according to claim 16, characterized in that an expansion or over-bending protector is provided for the spring arms (14) in the form of a stop element (23) at the outer protruding spring (16*a*) located to a side of a free front end of each spring arm (14).

20. A contact dement according to claim 19, characterized in that from a rear edge of the walls of the outer protruding spring (16) to the rear and the sides of the outer protruding spring (16), locking elements (41) are provided that extend across the cross-sectional contour of the outer protruding spring (16) and mesh with locking elements of a contact chamber wall of a plug connector housing in which the contact element is received.

21. A contact element according to claim 20, characterized in that the locking elements (41) are arms that extend at a right angle to the side and also are bent away to the rear of the outer protruding spring (16).

22. A contact element according to claim 20, characterized in that the locking elements (41) are designed as elongated spreader arms having free end edges that protrude outwardly at an acute angle from the cross-sectional contour of the outer protruding spring (16).

* * * * *

UNITED STATES PATENT AND TRADEMARK OFFICE

CERTIFICATE OF CORRECTION

PATENT NO. : 5,664,972

DATED : September 9, 1997

INVENTOR(S) : Zinn et al.

It is certified that error appears in the above-identified patent and that said Letters Patent is hereby corrected as shown below:

In each of columns 7, line 55; column 8, line 10; and column 8, line 49, "dement" should be --"element"--.

Signed and Sealed this

Seventeenth Day of February, 1998

*Attest:*

*Attesting Officer*

BRUCE LEHMAN

*Commissioner of Patents and Trademarks*